United States Patent [19]

Perez

[11] Patent Number: 4,864,840

[45] Date of Patent: Sep. 12, 1989

[54] RIVETING HEAD FOR STAPLING APPARATUS

[76] Inventor: Jorge G. Perez, C. Juan Sebastian Bach, 16, 08021 Barcelona, Spain

[21] Appl. No.: 25,229

[22] Filed: Mar. 12, 1987

[30] Foreign Application Priority Data

Mar. 19, 1986 [ES] Spain ..... 293.060

[51] Int. Cl.[4] ..... B25B 31/00; B21J 15/34

[52] U.S. Cl. ..... 72/391; 29/560; 227/156; 227/109

[58] Field of Search ..... 72/391, 114, 453.16; 227/156, 132, 109, 155, 120, 149; 29/40.1, 560

[56] References Cited

U.S. PATENT DOCUMENTS

| | | | |
|---|---|---|---|
| 2,075,162 | 3/1937 | Begg | 72/391 |
| 3,802,519 | 4/1974 | Newton | 72/391 |
| 4,344,311 | 8/1982 | Inoue | 72/391 |
| 4,619,394 | 10/1986 | Knispel et al. | 72/391 |

FOREIGN PATENT DOCUMENTS

| | | | |
|---|---|---|---|
| 2126142 | 3/1984 | United Kingdom | 72/391 |

*Primary Examiner*—David Jones

[57] ABSTRACT

A riveting head for coupling to a stapling apparatus, which is provided with a covering body, a member for removably engaging the covering body with the stapling apparatus, a pulling unit movably mounted within the covering body and formed to grip a stem in turn formed with a frangible head at one end thereof, in addition to an anvil bushing positioned on the covering body through which the stem extends when gripped by the pulling unit, and a multiplying lever pivotally mounted upon the covering body. The pulling unit is movably mounted upon the covering body through the multiplying lever which is provided with an end positioned to be actuated by a lever of the stapling apparatus.

9 Claims, 2 Drawing Sheets

RIVETING HEAD FOR STAPLING APPARATUS

BACKGROUND OF THE INVENTION

The present invention is concerned with a riveting head which may be fitted onto a stapling apparatus, by means of which it is possible to take advantage of the operating mechanism for the staple driver of such apparatus to power a riveting unit of the kind using rivet means made of a stem with a frangible riveting head at one end thereof. Therefore, one and the same apparatus becomes adapted for two different applications and may be used for stapling, according to its usual embodiment, or for riveting purposes, when the riveting head to be described is coupled thereto.

A problem which is encountered in driving a manual riveting unit of the indicated kind, involves the force that must be applied to the above rivet pulling head in order to attain breaking of the head of the rivet stem used for affixing, for example, a lead seal. In the known hand operated riveting apparatus, the force is attained by implementing the apparatus with a lever having a long operating arm, in order to multiply the forces applied to the grip thereof.

If the matter concerns making the most with the operating mechanism of a stapler apparatus, yet without modifying the operating lever thereof, it is necessary to multiply the force which is applied onto this lever, because in the original configuration of the stapling apparatus the operating lever is not long enough in view of the fact that the force which is necessary to actuate the staple driving unit is comparatively less than the force which is necessary to attain rupture of the stem head of a such rivet.

SUMMARY OF THE INVENTION

According to the stated scopes and with the aim of overcoming the above drawbacks, the riveting head that is the subject of the present invention and is adapted for fitting into manual operation stapler apparatus, has been devised.

The riveting head in question essentially comprises a box-like body provided with means for its removable engagement to the stapling head body of a manually operated stapler apparatus. Inside the riveting head body there is located a riveting unit of a known configuration, with a stem rivet pulling device or unit axially displaceable therein and formed with the rivet stem holding nip. The pulling device or unit has means for pivotally connecting a lever in turn articulated on the body itself and extended in a pawl which protrudes from the riveting head body or box and comes to a position within the stapling body which is in adjacent relation to the operating trigger of the stapler driving mechanism.

The head comprises as well means for returning the rivet pulling unit and the lever articulated to the latter towards their rest position once a riveting operation has been performed.

In a specific embodiment, a pusher protrudes outside the riveting head box and thus forms a push-button resting onto the lever articulated to the pulling unit or device, to return the ensemble of the riveting mechanism to its rest position.

It is advantageous that the end of the rivet pulling device or unit opposite to that where the rivet stem retaining nip is placed, extends in a pair of wings in the manner of a fork and has between these wings a stub shaft about which the operating lever for the rivet stem pulling device is mounted, the lever being articulated at one end thereof onto an axle fixed within the riveting head body or box, the opposite end thereof constituting the pawl which is to be operated by the stapler apparatus lever.

BRIEF DESCRIPTION OF THE DRAWINGS

For a better understanding of the present specification, the annexed drawings showing a practical embodiment of the riveting head according to the invention will be referred to hereafter.

In the drawings.

DESCRIPTION OF THE PREFERRED EMBODIMENTS

Figure 1:
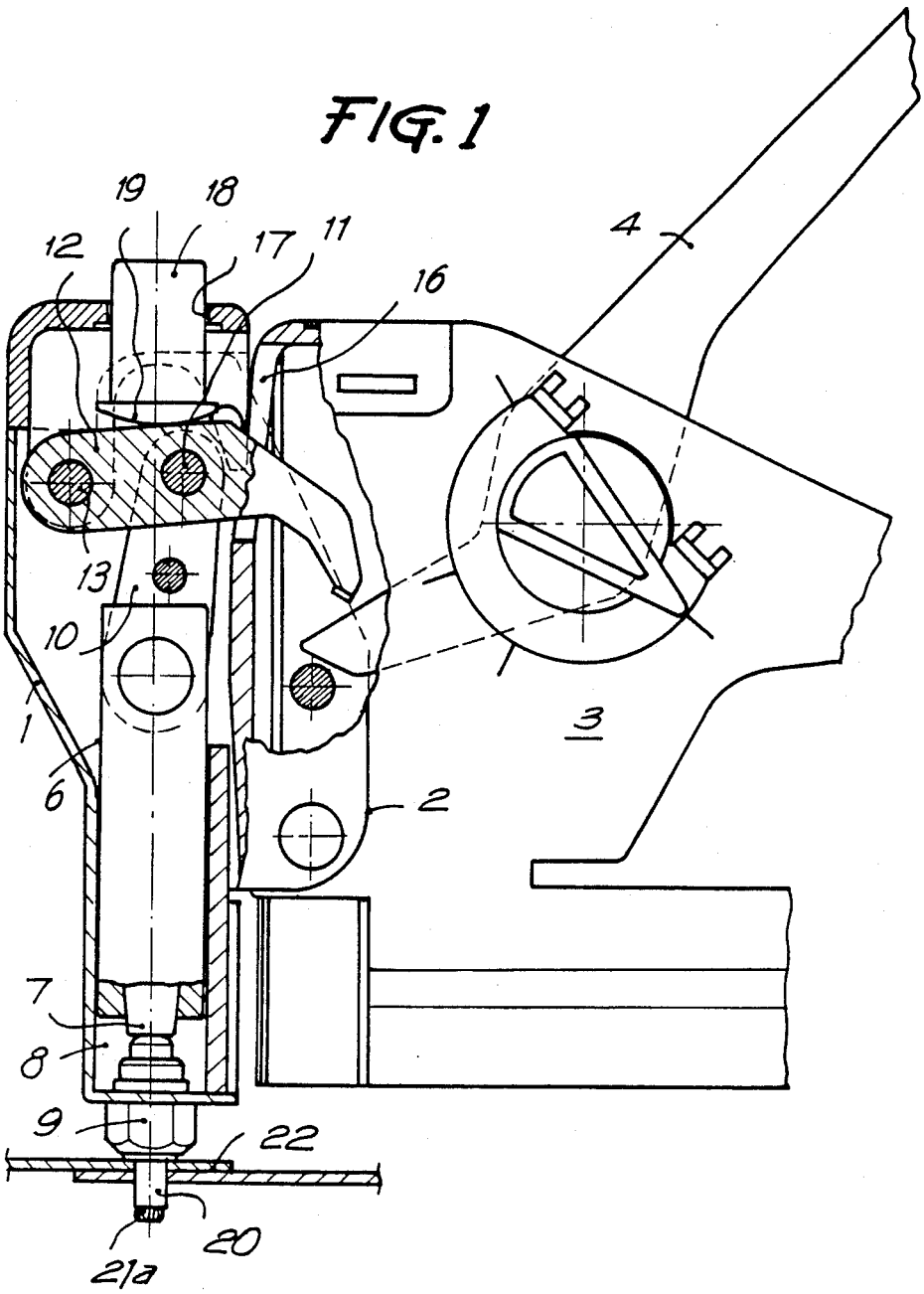
FIG. 1 is a longitudinal sectional view of the riveting head according to the invention as incorporated in a manually operated stapling apparatus shown in the rest position.

The riveting head adapted for engagement to a manually operated stapling apparatus, comprises, in the drawings, a box or cover 1 provided with wings 2 or another suitable means for removably connecting it to the stapling head of a stapler apparatus 3 which is manually operable by means of a lever 4 formed with a trigger 5 for operation of the staple driver mechanism of the stapler apparatus.

A riveting unit 6 is mounted within the box 1 and has its rivet stem holding nip 7, of a conventional configuration, guided within a cavity 8 of the box and terminated at its lowermost working end in an anvil bushing 9.

A pair of wings 10 forming a type of a fork, is provided at the end of the riveting or pulling unit 6 opposite to that which carries the rivet holding nip 7 and is supported on a shaft 11 about which a second class lever 12 is mounted or articulated, this lever being articulated at one end thereof about an axle 13 mounted within the body 1, while its other end forms a pawl 14 protruding outside the riveting head body 1 through a window 15 which, in the assembled head body 1, comes in juxtaposed relation to a window 16 of the stapling head of stapling apparatus 3, and rests upon the trigger 5 of the operating lever 4 of the latter.

An opening 17 is formed in the cover body 1, and a push-button 18 protrudes therethrough and has a rounded head 19 resting on the riveting head lever 12.

Figure 2:
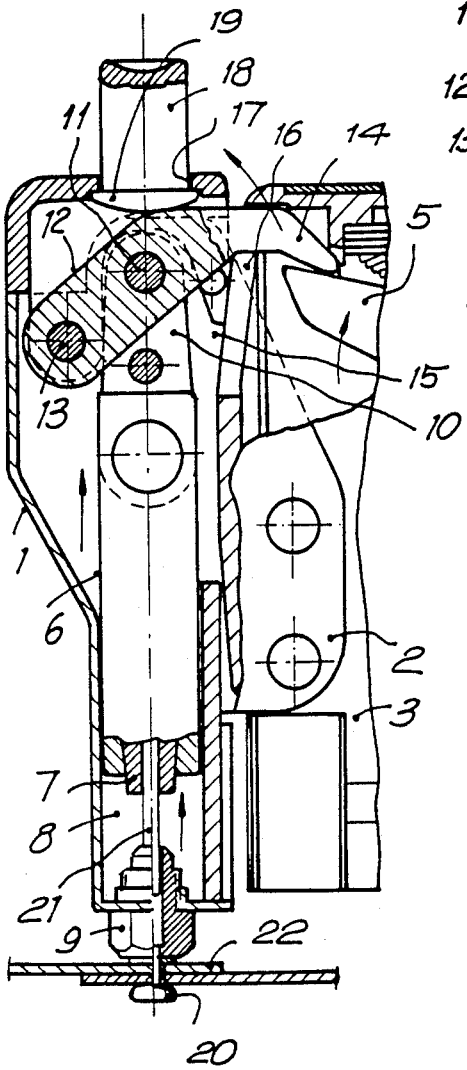
FIG. 2 is a view similar to FIG. 1 showing the ensemble of the mechanism in its working position.
Figure 3:
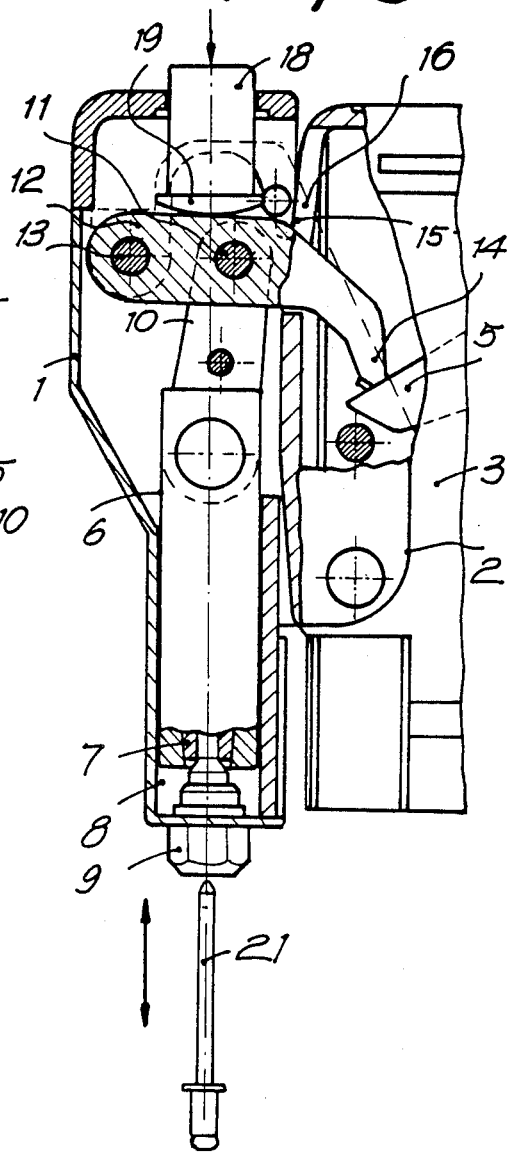
FIG. 3 is a similar view showing the returning of the riveting head parts to their rest position.

As easily appears from the foregoing and in viewing the drawings, the riveting head operates as follows: once the eyelet 20 to be riveted has been placed with its stem 21, and thus the head 21a, in the position for riveting a pair of plates 22, or whatever component in which the rivet is to be placed, the stem 21 being suitably secured by the nip 7, with the anvil 9 resting against the components 22 (FIG. 1), a force applied by hand to the operating lever 4 of the stapling apparatus is transmitted to the trigger 5 of the lever and from this latter to the pawl 14 of the riveting head lever 12. The lever 12 multiplies the force, rocks about the fixed axis 13 and draws, through wings 10, the riveting unit 6 carrying the nip 7, with a force enough for the head **21*a* of the riveting stem to perform riveting of the eyelet 20 (FIG. 2) as well as breaking of the head 21a. The head 21*a*** becomes separated from the stem 21 and both may be removed from both sides of the components. As indicated by means of a two-pointed arrow in FIG. 3, the used stem rivet can be removed from the nip 7 and substituted by a new one.

The rivet 20 is of a well known kind that can be inserted in a rivet receiving drill-hole from one side of the components to be affixed and is riveted at the other side of the same, thus providing some advantages in its placing.

For returning the riveting device to its rest position, it is necessary to depress the push-button 18 so that this acts upon the riveting head lever 12 and forces it to rock about the axis 13 thus placing the pulling unit 6 in its first position.

Owing to the arrangement of the riveting head lever 12, connected to the pulling unit 6 through the shaft 11 in turn mounted on the wings 10, the force applied to the lever 4 of the stapler apparatus is multiplied and becomes large enough to perform the riveting function as described above.

In short, owing to the optional incorporation of the described riveting head, a stapling apparatus can be adapted for performing the function of a riveting apparatus, without the need for making fundamental modification in the operating system of the stapler.

The materials used in the manufacture of the head parts, as well as the shapes and measurements of these, and any ancillary details which might come in account, will be independent of the invention subject, provided that they do not affect to the essentials thereof.

I claim:

1. Riveting head for coupling to stapling apparatus, said riveting head comprising a covering body, means for removably engaging said covering body with a stapling apparatus, a pulling unit movably mounted within said covering body and formed to grip a stem in turn formed with a frangible head at one end thereof, an anvil bushing positioned on said covering body through which the stem extends when gripped by said pulling unit, and a multiplying lever pivotally mounted upon said covering body with said pulling unit being movably mounted upon said covering body through said multiplying lever which is provided with an end positionable for actuation by a lever of a stapling apparatus, said multiplying lever being pivotally mounted upon said covering body separate and apart from the lever of the stapling apparatus, and additionally comprising an axle mounted upon said covering body and upon which said multiplying lever is pivotally mounted substantially at an end opposite said end positionable for actuation, and a shaft positioned on said multiplying lever intermediate said ends thereof and upon which said pulling unit is mounted.

2. The combination of claim 1, wherein said pulling unit comprises a pair of wings, each said wing mounted upon said shaft.

3. The combination of claim 1, additionally comprising means for returning said pulling unit and multiplying lever to rest position, after riveting.

4. Riveting head for coupling to stapling apparatus, said riveting head comprising a covering body, means for removably engaging said covering body with a stapling apparatus, a pulling unit movably mounted within said covering body and formed to grip a stem in turn formed with a frangible head at one end thereof, an anvil bushing positioned on said covering body through which the stem extends when gripped by said pulling unit, a multiplying lever pivotally mounted upon said covering body with said pulling unit being movably mounted upon said covering body through said multiplying lever which is provided with an end positionable for actuation by a lever of a stapling apparatus, and means for returning said pulling unit and multiplying lever to rest position, after riveting, wherein said returning means comprise a push-button protruding through an opening in said covering body and having a rounded head resting upon said multiplying lever.

5. Riveting head for coupling to stapling apparatus, said riveting head comprising a covering body, means for removably engaging said covering body with a stapling apparatus, a pulling unit movably mounted within said covering body and formed to grip a stem in turn formed with a frangible head at one end thereof, an anvil bushing positioned on said covering body through which the stem extends when gripped by said pulling unit, and a multiplying lever pivotally mounted upon said covering body with said pulling unit being movably mounted upon said covering body through said multiplying lever which is provided with an end positionable for actuation by a lever of a stapling apparatus, wherein said end of said multiplying lever is in the shape of a pawl.

6. The combination of claim 1, wherein said pulling unit additionally comprises a nip for gripping the stem.

7. The combination of claim 5, wherein said covering body defines a cavity shaped for axially guiding movement of said pulling unit with respect to said covering body.

8. The combination of claim 5, wherein said covering body additionally comprises a window through which said pawl protrudes.

9. The combination of claim 1, wherein said multiplying lever is positionable to multiply force exerted upon a stapling apparatus lever and positionable to rotate about said covering body in a counterclockwise direction when a stapling apparatus lever is rotated in a clockwise direction.

* * * * *

UNITED STATES PATENT AND TRADEMARK OFFICE

CERTIFICATE OF CORRECTION

PATENT NO. : 4,864,840

DATED : September 12, 1989

INVENTOR(S) : Jorge Grau Perez

It is certified that error appears in the above-identified patent and that said Letters Patent is hereby corrected as shown below:

On the title page Insert

--(73) Assignee: Esselte Business Systems, S.A., Spain --.

Signed and Sealed this

Eleventh Day of September, 1990

*Attest:*

*Attesting Officer*

HARRY F. MANBECK, JR.

*Commissioner of Patents and Trademarks*